US006485333B1

(12) United States Patent
Shinchi

(10) Patent No.: US 6,485,333 B1
(45) Date of Patent: Nov. 26, 2002

(54) WATERPROOF CONNECTOR

(75) Inventor: Akira Shinchi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/678,837

(22) Filed: Oct. 4, 2000

(30) Foreign Application Priority Data

Oct. 8, 1999 (JP) ..... 11-288521

(51) Int. Cl.[7] ..... H01R 9/05

(52) U.S. Cl. ..... 439/587; 439/465; 439/463; 439/731; 439/606; 439/596; 439/519; 174/77 R

(58) Field of Search ..... 439/587, 465, 439/467, 731, 596, 603, 519, 521, 523, 752; 194/77 R

(56) References Cited

U.S. PATENT DOCUMENTS 4,719,321 A * 1/1988 Kozel ..... 174/135
5,274,194 A * 12/1993 Belcher ..... 174/50
5,569,050 A * 10/1996 Lloyd ..... 439/465
5,683,272 A * 11/1997 Abe ..... 439/747
5,928,033 A * 7/1999 Kato et al. ..... 439/587
5,957,732 A * 9/1999 Ito et al. ..... 439/752

FOREIGN PATENT DOCUMENTS

GB 2321346 A * 7/1998
JP 10-241782 9/1998

* cited by examiner

*Primary Examiner*—Tho D. Ta
*Assistant Examiner*—Larisa Tsukerman
(74) *Attorney, Agent, or Firm*—Finnegan, Henderson, Farabow, Garrett & Dunner, L.L.P.

(57) ABSTRACT

A waterproof structure is achieved by inserting a covered electric wire 40 obtained by covering an outer periphery of a conductor portion 41 with a cover portion 42 made of a resin into an electric wire inserting hole 28 of a connector main body 21 inserted to a terminal receiving chamber 24 in a state of being connected to a terminal received in a terminal receiving chamber 24 of the connector main body 21 and welding the cover portion 42 and the electric wire inserting hole 28 in accordance with a ultrasonic oscillation and a pressurization from an outer side. The connector main body 21 has a weld depth setting portion 47 for setting a weld depth, whereby an excessive welding is prevented.

6 Claims, 6 Drawing Sheets

WATERPROOF CONNECTOR

BACKGROUND OF THE INVENTION

The present invention relates to a waterproof connector for waterproofing a covered electric wire.

A waterproof connector for waterproofing a covered electric wire is disclosed in Japanese Patent Application Laid-open No. 10-241782. A waterproof connector 1 has a waterproof construction structured such that a covered electric wire 3 introduced from a housing 2 is covered in such a manner as to be held between two separated waterproof members 4 and 5 and the waterproof members 4 and 5 in a covered state are supported by two separated covers 6 and 7 integrally formed with the housing 2, as shown in FIG. 1. The housing 2 has a guide portion 8 protruding forward so as to form a small rectangular column at an end surface thereof, as shown in FIG. 2. A guide hole 9 opening to a front end surface thereof and communicating with an inner portion of the housing 2 are punched in the guide portion 8. The covered electric wire 3 is structured such as to be outward introduced through the guide hole 9, as shown in FIG. 3. The covered electric wire 3 is constituted by a conductor portion 3*a* and a cover portion 3*b* for covering the conductor portion 3*a*, and the cover portion 3*b* is made of a resin. Further, the waterproof members 4 and 5 respectively have electric wire receiving grooves 12 and 13 partitioned by ribs 10 and 11 in sides of opposing surfaces to each other, and these electric wire receiving grooves 12 and 13 are provided in correspondence to the guide hole 9. The waterproof members 4 and 5 are respectively integrally formed with the covers 6 and 7, and the covers 6 and 7 including the waterproof members 4 and 5 and the housing 2 can be welded with each other in accordance a ultrasonic oscillation under pressure, and are formed by a resin having a compatibility with the cover portion 3*b* of the covered electric wire 3.

The waterproof connector 1 is assembled by at first engaging a terminal (not shown) connected to the covered electric wire 3 within the housing 2 and guiding the covered electric wire 3 outward from the guide hole 9. Next, the covered electric wire 3 is fitted to each of the electric wire receiving grooves 12 and 13 of the waterproof members 4 and 5, and the ribs 10 and 11 are faced to each other, whereby the covers 6 and 7 are faced to each other along a vertical direction. Due to the facing, both side ribs 6*a* and 7*a* of the covers 6 and 7 are opposed to each other, and inner surfaces 6*b* and 7*b* in a rear end side are opposed to an outer peripheral surface 8*a* of the guide portion 8. With keeping this state, as shown in FIG. 3, a ultrasonic oscillation is applied while pressurizing by a horn 14 from an upper portion of the upper cover 6 in a state of being mounted on a table (not shown). Due to the ultrasonic oscillation, the inner surfaces 6*b* and 7*b* in the rear end side of the covers 6 and 7 are welded to the outer peripheral surface 8*a* of the guide portion 8 so as to be integrally formed with the housing 2, the corresponding ribs 10 and 11 of the waterproof members 4 and 5 are welded so as to be integrally formed, and the connecting portion between the electric wire receiving grooves 12 and 13 of the waterproof members 4 and 5 and the cover portion 3*b* of the covered electric wire 3 is welded so as to be integrally formed with the covered electric wire, whereby it is possible to obtain a waterproof structure.

However, in the waterproof connector provided with the conventional waterproof construction mentioned above, a welding depth of the covers 6 and 7 including the waterproof members 4 and 5 is not set. Accordingly, there is a case that an excessive welding is performed at a time of welding in accordance with the ultrasonic oscillation and the pressurization. When the excessive welding is performed, there is a case that a sealing performance can not be obtained and there is a problem that a sufficient waterproof property can not be secured. Further, in the conventional waterproof connector, at a time of welding in accordance with the ultrasonic oscillation and the pressurization, there is a case that the resin leaks out to outer portions in both right and left sides of the welded resin covers 6 and 7 from the welded surface thereof, as shown by reference symbol S in FIG. 4. Accordingly, there is a problem that an outer appearance of the waterproof connector is deteriorated by the leaked out resin being hardened.

SUMMARY OF THE INVENTION

The present invention has been achieved by paying attention to the problems mentioned above, and an object of the present invention is to provide a waterproof connector which can prevent an excessive welding and can prevent a welded resin from leaking out.

In order to achieve the object mentioned above, a first aspect of the invention provides a waterproof connector having a waterproof structure. This is achieved by inserting a covered electric wire obtained by covering an outer periphery of a conductor portion with a cover portion made of a resin into an electric wire inserting hole defined by wire receiving grooves of a connector main body. The connector main body is inserted into a terminal receiving chamber and the cover portion and the surfaces of the electric wire receiving grooves are welded together in accordance with an ultrasonic oscillation and a pressurization from an outer side. Additionally, a weld depth setting portion for setting a weld depth at a time of welding in accordance with the ultrasonic oscillation and the pressurization is provided in the connector main body.

Further, a second aspect of the invention provides a waterproof connector according to the first aspect, wherein the connector main body is provided with an electric wire receiving table having a side wall including a weld line portion, and an electric wire receiving groove, and a cover having a side wall portion including a weld line portion welded to the weld line portion of the connector main body and a cover surface portion including an electric wire receiving groove forming the electric wire Inserting hole by being aligned with the electric wire receiving groove, the cover being covered over the electric wire receiving table, the weld depth setting portion is constituted by a receiving portion provided in one of the electric wire receiving table and the cover, and a contact portion provided in the other of said electric wire receiving table and said cover, and the receiving portion and the contact portion are brought into contact with each other, whereby the weld depth is set.

Further, a third aspect of the invention provides a waterproof connector according to the second aspect, wherein the contact portion is provided in the outer surface side of the side wall portion in the cover surface portion of the cover, and the receiving portion is provided in the outer surface side of the side wall portion in the electric wire receiving table.

Further, a fourth aspect of the invention provides a waterproof connector according to the third aspect, wherein the contact portion is constituted by the outer wall portion provided in the outer surface side of the side wall portion in the cover surface portion of the cover, and the receiving portion is constituted by a rib provided in a substantially center portion in a vertical direction of the outer surface side of the side wall portion in the electric wire receiving table.

In accordance with these inventions, it is possible to securely achieve the object of the invention described in the first aspect.

A fifth aspect of the invention provides a waterproof connector according to the first aspect, wherein the connector main body is provided with an electric wire receiving table having a side wall including a weld line portion, and an electric wire receiving groove, and a cover having a side wall portion including a weld line portion welded to the weld line portion and a cover surface portion including an electric wire receiving groove forming the electric wire inserting hole by being aligned with the electric wire receiving groove, the cover being covered over the electric wire receiving table, the weld depth setting portion is constituted by a rib having a weld depth setting line portion provided in a substantially center portion in a vertical direction of an outer surface side of a side wall portion in the electric wire receiving table, and an outer wall portion having a setting line portion provided in an outer surface side of a side wall portion in the cover surface portion and brought into contact with the weld depth setting line portion, and the outer wall portion is provided so as to protrude in a direction of thickness of the cover from the weld surface in which the weld line portions are welded to each other.

In accordance with the present invention, the respective weld line portions and the weld depth setting line portions are faced to each other by covering the cover over the electric wire receiving table. In accordance with the ultrasonic oscillation, the weld line portions are welded to each other, however, since the outer wall portion protrudes outward in the direction of the thickness of the cover from the weld surface of the weld line portion, the ultrasonic oscillation is not transmitted to the weld depth setting line portion, and the oscillation is fine even when being transmitted, so that the weld depth setting line portions are not welded to each other. Further, since the weld depth setting line portion of the outer wall portion in the cover side is brought into contact with the weld depth setting line portion of the rib in the electric wire receiving table side, it is possible to prevent the weld line portions from being excessively welded, so that the cover and the electric wire receiving table can be firmly combined and the waterproof property can be secured. Further, in accordance with the present invention, since the electric wire inserting hole is separated into the electric wire receiving groove in the electric wire receiving table side and the electric wire receiving groove in the cover side, it is possible to easily insert the covered electric wire into the electric wire inserting hole.

A sixth aspect of the invention provides a waterproof connector according to the first aspect, wherein the weld depth setting portion is a weld resin leakage preventing portion for preventing the resin weld in the weld line portion from leaking outward from the connector main body at a time of welding in accordance with the ultrasonic oscillation and the pressurization.

A seventh aspect of the invention provides a waterproof connector according to the fifth aspect, wherein the weld depth setting portion is a weld resin leakage preventing portion for preventing the resin weld in the weld line portion from leaking outward from the connector main body at a time of welding in accordance with the ultrasonic oscillation and the pressurization.

In accordance with these inventions, since the outer wall portion of the cover protrudes outward in the direction of the thickness of the cover from the weld surface of the weld line portion, it is possible to prevent the resin weld in the weld line portion from leaking outward from the connector main body at a time of welding in accordance with the ultrasonic oscillation and the pressurization. Accordingly, since the outer appearance of the welded waterproof connector is not deteriorated, it is possible to keep a good outer appearance.

BRIEF DESCRIPTION OF THE DRAWINGS

FIG. 6 is a perspective view in a state that an upper cover is put on;

DESCRIPTION OF THE PREFERRED EMBODIMENT

FIGS. 5 to 8 show a waterproof connector provided with a waterproof structure in accordance with an embodiment of the present invention.

Figure 1:
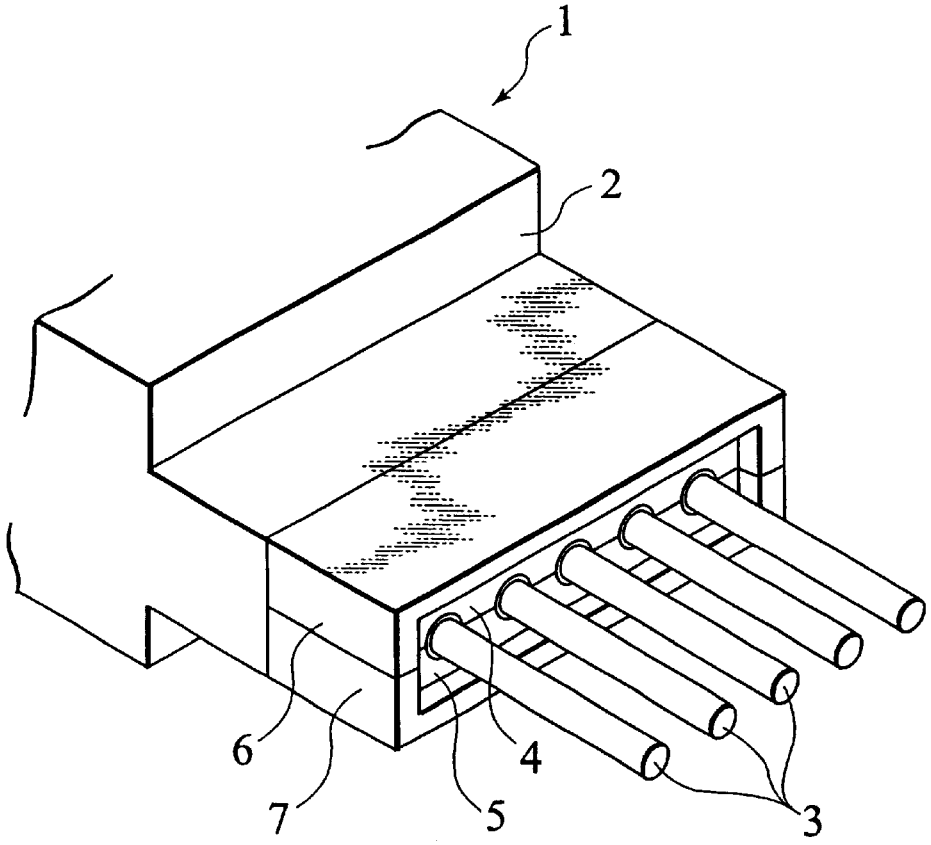
FIG.1 PRIOR ART
FIG. 1 is a perspective view of a whole of a waterproof connector provided with a conventional waterproof structure.
Figure 2:
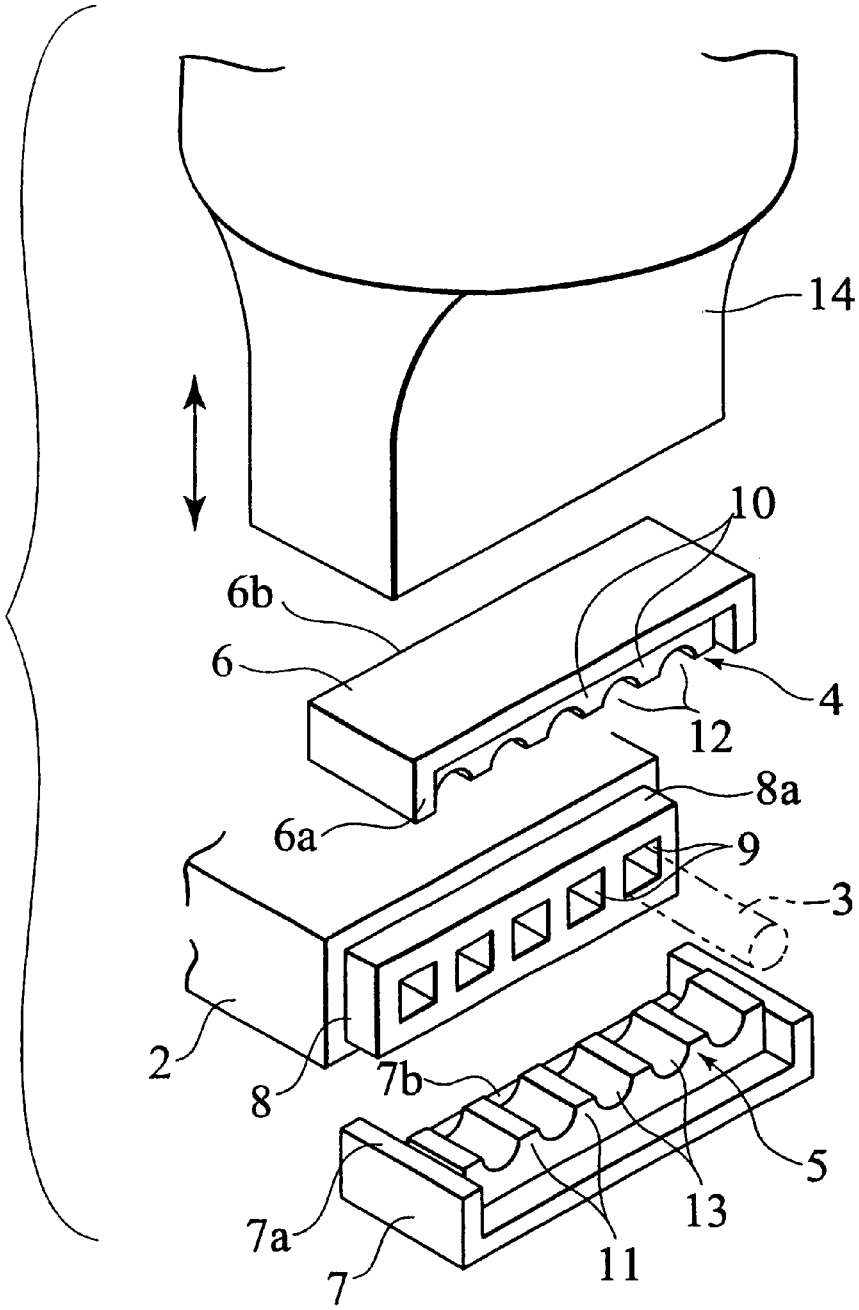
FIG.2 PRIOR ART
FIG. 2 is an exploded perspective view showing a producing step of the conventional waterproof connector.
Figure 3:
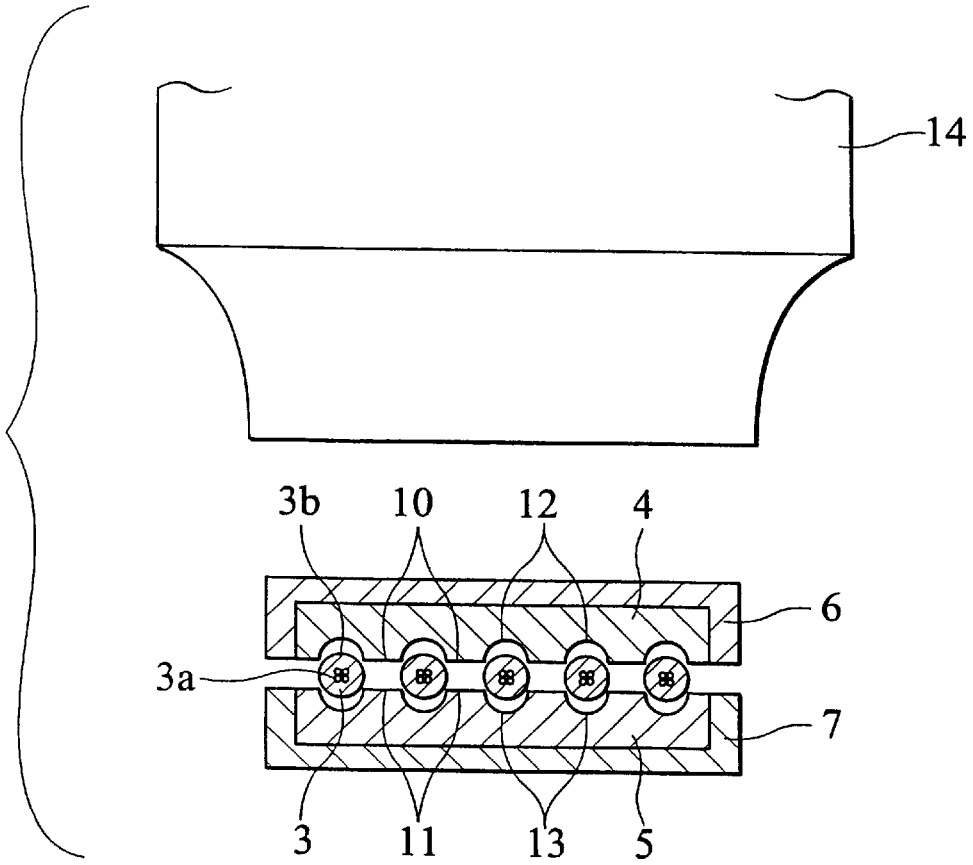
FIG.3 PRIOR ART
FIG. 3 is a partly cross sectional view showing a state that a ultrasonic oscillation is applied with covering the conventional waterproof connector.
Figure 4:
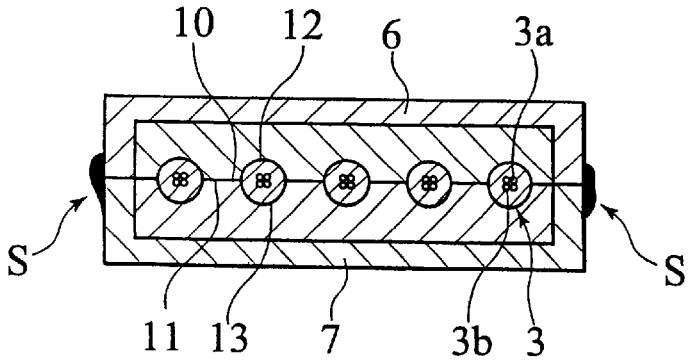
FIG.4 PRIOR ART
FIG. 4 is a partly cross sectional view explaining problems in the conventional waterproof connector.
Figure 5:
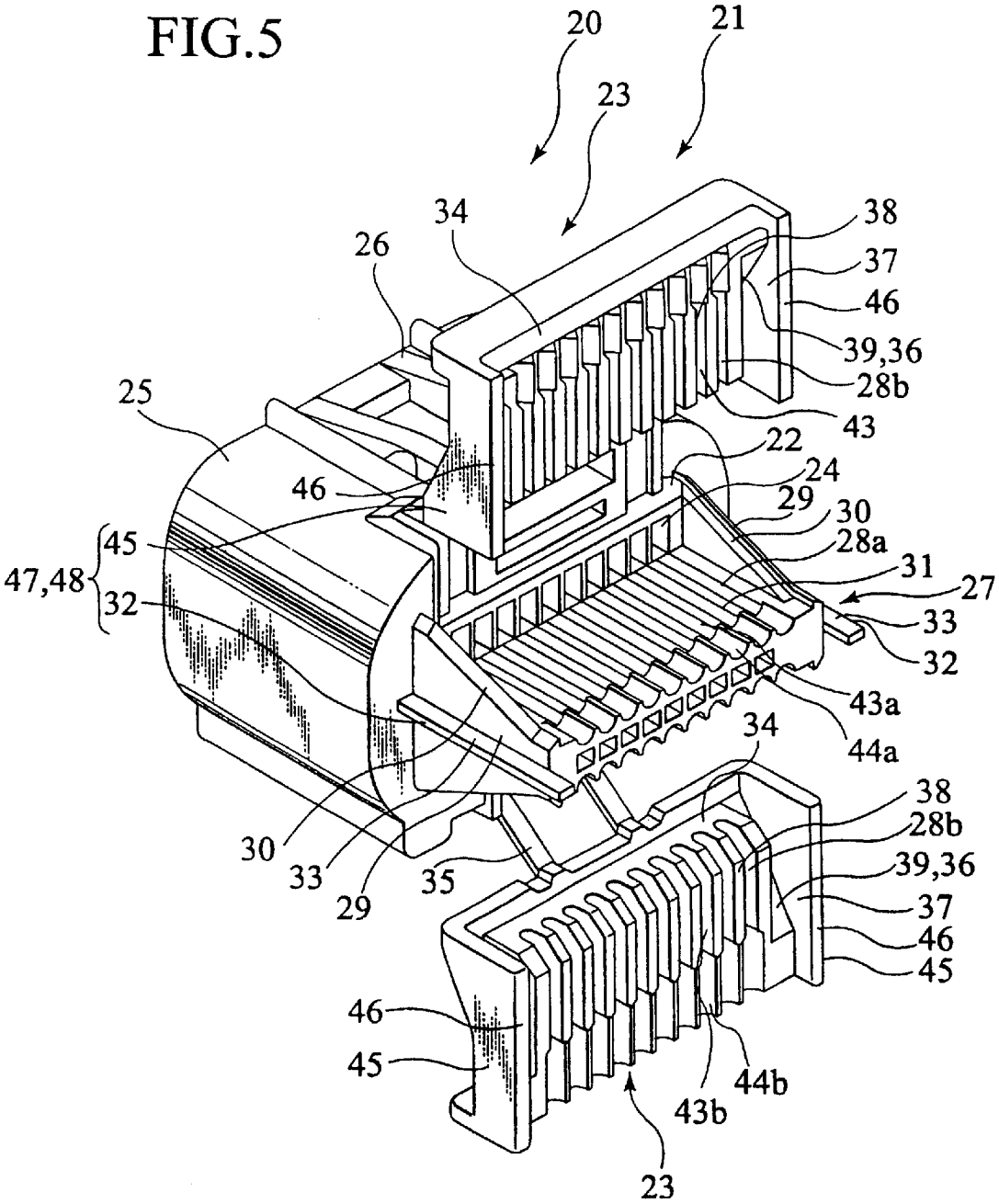
FIG. 5 is a perspective view of a whole of a waterproof connector provided with a waterproof structure in accordance with an embodiment of the present invention.
Figure 6:
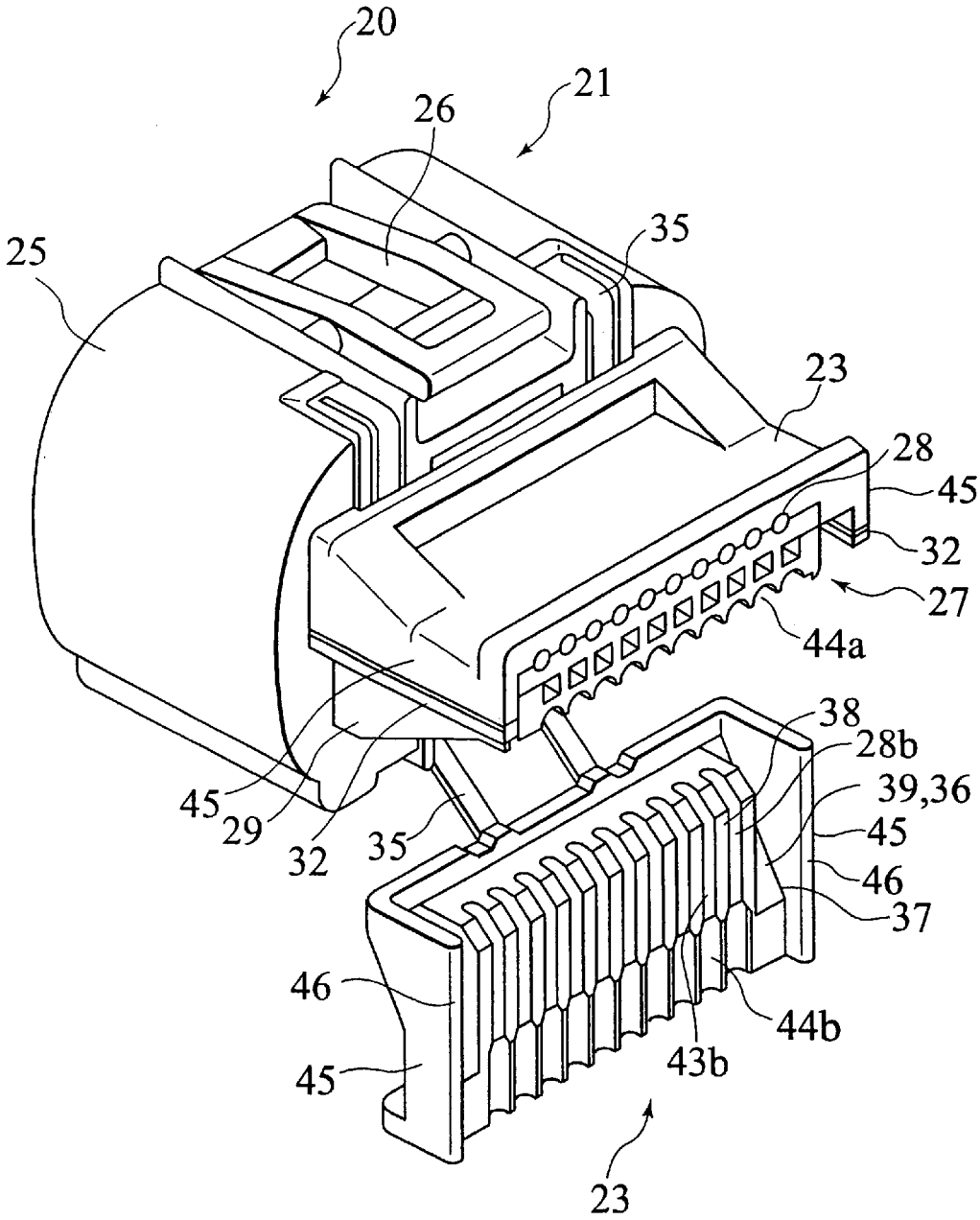

As shown in FIGS. 5 and 6, a waterproof connector 20 has a connector main body 21 constituted by a housing 22 and a cover 23. The housing 22 has a plurality of terminal receiving chambers 24 for receiving terminals (not shown) in one horizontal lines and two upper and lower stages.

A hood portion 25 for inwardly surrounding the housing 22 is provided in an outer side of the housing 22. The hood portion 25 is formed by a curve-shaped rectangular cylinder body and has an open front end surface. An opposing connector (not shown) is inserted from the open portion so as to be fitted. Further, a lock arm 26 for locking the fitting state of the opposing connector is provided on an upper surface of the hood portion 25. In this case, a rear surface of the hood portion 25 is closed except the terminal receiving chambers 24 and electric wire receiving grooves 28*a* of an electric wire receiving table 27 mentioned below.

As shown in FIG. 5, the electric wire receiving table 27 is formed in a flat rectangular shape, and the electric wire receiving grooves 28*a* communicating in correspondence to the respective terminal receiving chambers 24 are formed on upper and lower surfaces thereof so as to form a line. Further, substantially triangular side wall portions 29 connected to a rear surface of the hood portion 25 and having a width becoming smaller toward a rear portion are integrally formed in right and left end portions of the electric wire receiving table 27, and upper and lower end surfaces of the side wall portion 29 constitute weld line portions 30 welded to the cover 23 in accordance with a ultrasonic oscillation. The electric wire receiving grooves 28*a* are formed by being partitioned by partition portions 31 provided between the right and left side wall portions 29 in a parallel manner.

Further, substantially rectangular ribs 32 connected to the rear surface of the hood portion 25 and moving rearward are integrally formed on outer side surfaces of the right and left side wall portions 29, and upper and lower end surfaces of the ribs 32 constitute weld depth setting line portions 33 for setting a weld depth in accordance with the ultrasonic oscillation. The ribs 32 are provided in a substantially center portion in a vertical direction of the side wall portion 29.

The covers 23 are provided in upper and lower portions in correspondence to the upper and lower surfaces of the electric wire receiving table 27. Each of the respective covers 23 has a rectangular cover surface portion 34 having the same size as that of the electric wire receiving table 27 and can cover all the surface of the upper and lower surfaces of the electric wire receiving table 27 by being put on the electric wire receiving table 27. In the embodiment, the upper and lower covers 23 are connected to the hood portion 25 via hinges 35 provided on the rear surface of the hood portion 25, and the hinges 35 are rotated, whereby the respective covers 23 are put on the electric wire receiving table 27 from upper and lower portions. In this case, the structure may be made such that the covers 23 may be formed as independent parts without being connected by the hinges 35.

The cover surface portions 34 of the covers 23 have right and left side wall portions 37 having taper surfaces 36 corresponding to the side wall portions 29 of the electric wire receiving table 27, and partition wall portions 38 provided between the right and left side wall portions 37 in parallel, and spaces defined by the side wall portions 37 and the partition wall portions 38 constitute the electric wire receiving grooves 28*b*. The electric wire receiving grooves 28*b* are aligned with the electric wire receiving grooves 28*a* in the side of the electric wire receiving table 27 by putting the covers 23 on the electric wire receiving table 27. Then, the electric wire receiving grooves 28*a* and 28*b* are aligned with each other, whereby the electric wire inserting holes 28 to which covered electric wires 40 are inserted are formed in the connector main body 21. The electric wire receiving table 27 and the electric wire receiving grooves 28*a* and 28*b* of the covers 23 which form the electric wire inserting holes 28 are all structured in a two-stage construction having small diameter groove portions 43*a* and 43*b* in the side of the terminal receiving chamber 24 and large diameter groove portions 44*a*and 44*b* in the opposite side to the terminal receiving chamber 24. Accordingly, the electric wire inserting holes 28 formed by the electric wire receiving grooves 28*a* and 28*b* being aligned with each other is structured in a two-stage construction in which small diameter hole ends 43 and large diameter hole portions 44 are communicated with each other. Further, taper surfaces 36 of the right and left side wall portions 37 mentioned above are closely attached to the weld line portions 30 of the electric wire receiving table 27 and constitute weld line portions 39 welded to the weld line portion 30 in accordance with the ultrasonic oscillation.

The covers 23 are formed in a rectangular shape having a width larger than a width of the electric wire receiving table 27, and have right and left outer wall portions 45 provided in the side of the outer surfaces of the right and left side wall portions 37 in the cover surface portions 34.

Figure 7:
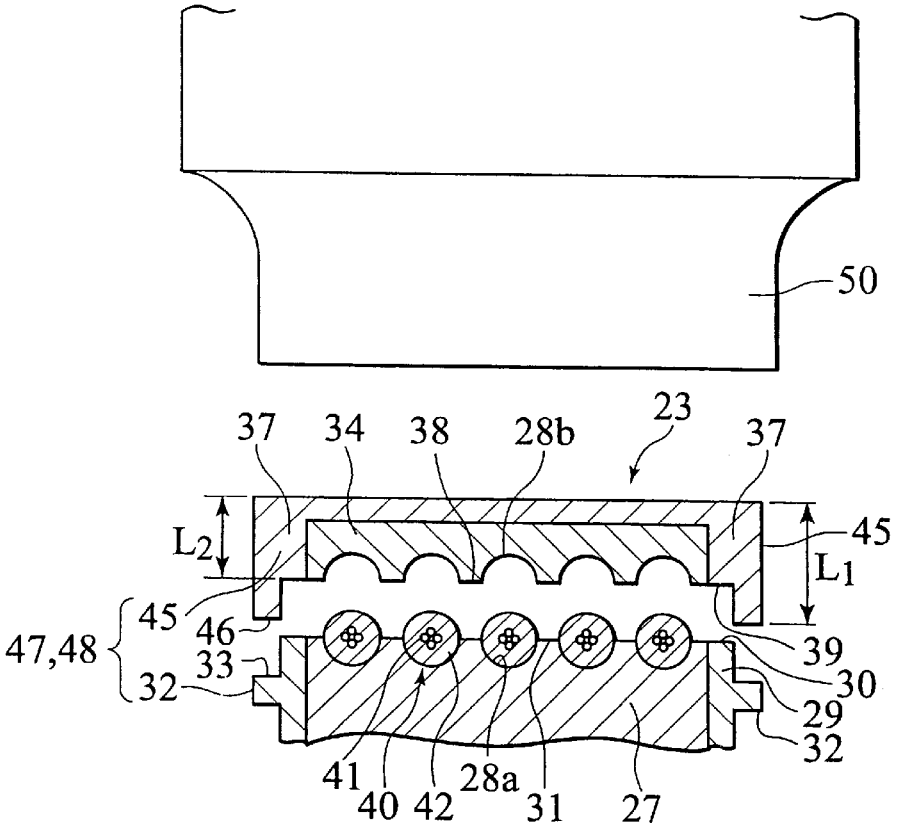
FIG. 7 is a partly cross sectional view showing a state that a ultrasonic oscillation is applied with putting on the cover.
Figure 8:
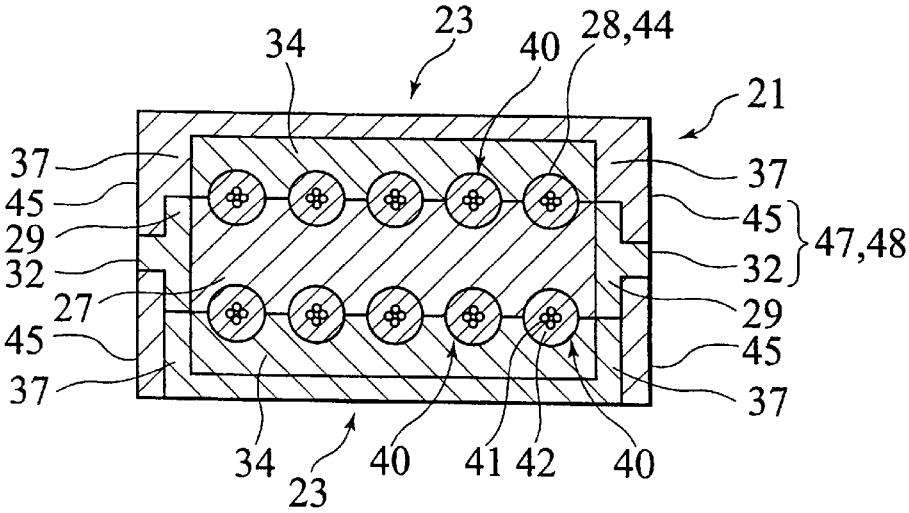
FIG. 8 is a partly cross sectional view explaining an operation.

The outer wall portions 45 have a vertical thickness L1 in which the front end surfaces thereof are brought into contact with the weld depth setting line portions 33 of the ribs 32 provided in the side wall portions 29 of the electric wire receiving table 27 when putting the covers 23 on the electric wire receiving table 27. Then, the thickness L1 of the outer wall portions 45 is formed so as to be larger than a vertical thickness L2 of the covering surface portions 34 of the covers 23, as shown in FIGS. 7 and 8.

Accordingly, the outer wall portions 45 protrude outward in the direction of the thickness of the covers 23 from the weld surfaced on which the weld line portions 30 and 39 are welded to each other.

The front end surfaces of the outer wall portions 45 mentioned above constitute weld depth setting line portions 46 brought into contact with the weld depth setting line portions 33 of the ribs 32 provided in the electric wire receiving table 27.

Then, weld depth setting portions 47 for setting the weld depth of the weld line portions 30 and 39 at a time of welding in accordance with the ultrasonic oscillation and the pressurization are constituted by the right and left ribs 32 provided in the electric wire receiving table 27 and the right and left outer wall portions 45 respectively provided in the upper and lower covers 23.

The weld depth setting portions 47 constitute weld resin leakage preventing portions 48 for preventing the welded resin in the weld line portions 30 and 39 from leaking outward from the connector main body 21 by covering weld surfaces where the weld line portions 30 of the electric wire receiving table 27 and the weld line portions 39 of the cover surface portions 34 are welded to each other, by the outer wall portions 45, at a time of welding in accordance with the ultrasonic oscillation and the pressurization, as shown in FIG. 8.

The covered electric wire 40 is constituted by a conductor portion 41 and a cover portion 42 for covering the conductor portion 41, and the cover portion 42 is made of a resin. As the resin of the cover portion 42, a vinyl chloride is employed. On the contrary, a whole of the connector main body 21 including the housing 22 and the cover 23 is made of an acrylic resin, an ABS (an acrylic-butadiene-styrene) resin, a PC (a polycarbonate) resin, a polyolefine resin such as a polyethylene or the like, a PEI (a polyether imide) resin, a PBT (a polybutylene terephthalate) resin, or the like. These resins has a property harder than the resin in the cover portion 42.

Next, a description will be given of an assembly of the embodiment.

In a state of opening the cover 23 shown in FIG. 5, the terminals (not shown) connected to the covered electric wires 40 are received in the respective terminal receiving chambers 24 in the housing 22. At a time of receiving mentioned above, the respective covered electric wires 40 are dropped to the respective electric wire receiving grooves 28*a* in the electric wire receiving table 27.

Then, by rotating the hinges 35, the covers 23 are put on the upper and lower surfaces of the electric wire receiving table 27, as shown in FIG. 6. By putting the covers 23 on, the weld line portions 30 of the electric wire receiving table 27 and the weld line portions 39 of the covers 23 are closely attached to each other and the electric wire receiving grooves 28*a* of the electric wire receiving table 27 and the electric wire receiving grooves 28*b* of the cover surface portions 34 in the covers 23 are aligned with each other, whereby the electric wire inserting holes 28 to which the covered electric wires 40 are inserted are formed. At the same time, the weld depth setting line portions 33 of the ribs 32 in the electric wire receiving table 27 and the weld depth setting portions 47 of the outer wall portions 45 in the covers 23 are brought into contact with each other.

Next, the lower cover 23 is mounted on an anvil (not shown) and the upper cover 23 is brought into contact with a horn 50, whereby a ultrasonic oscillation of a vertical vibration is applied thereto from the horn 50 while holding the covers 23 between the anvil and the horn 50 and pressurizing them (refer to FIG. 7). The covered portion 42 of the covered electric wire 40 being contact with the electric wire receiving table 27 and the cover surface portions 34 of the covers 23 is first welded due to the vertical vibration applied by the ultrasonic oscillation, and thereafter, the contact portion of the electric wire receiving table 27 and the cover surface portions 34 of the covers 23 being contact with the covered electric wire 40 is welded.

Since these welded resin are mixed, a resin connection layer integrally formed by being welded to the covered electric wire 40 is formed on a boundary face between the electric wire inserting hole 28 and the covered electric wire 40 by being hardened. Accordingly, water can not enter from a portion between the electric wire inserting hole 28 and the covered electric wire 40, whereby a good waterproof structure can be obtained. Further, continuously applying the ultrasonic oscillation, the weld line portions 30 of the electric wire receiving table 27 and the weld line portions 39 of the cover surface portions 34 of the covers 23 are welded and adhered. Due to the weld and adhesion, the electric wire receiving table 27 and the covers 23 are connected and integrally formed.

In accordance with the ultrasonic oscillation, the weld line portions 30 of the electric wire receiving table 27 and the weld line portions 39 of the cover surface portions 34 in the covers 23 are welded to each other, however, since the outer wall portions 45 of the covers protrude outward in the direction of the thickness of the cover 23 from the weld surfaces between the weld line portions 30 and 39 and the thickness of the resin is larger, the ultrasonic oscillation is not transmitted to the contact surface between the weld depth setting line portions 46 of the outer wall portion 45 and the weld depth setting line portions 33 of the ribs 32, and the vibration is fine even when being transmitted, so that weld depth setting line portions 46 and 33 can not be welded to each other.

Further, since the weld depth setting line portions 46 of the outer wall portion 45 in the side of the cover 23 are brought into contact with the weld depth setting line portions 33 of the ribs 32 in the side of the electric wire receiving table 27, it is possible to prevent the weld line portions 30 of the electric wire receiving table 27 and the weld line portions 39 of the covers 23 from being excessively welded. Accordingly, since it is possible to firmly connect the covers 23 and the electric wire receiving table 27, and a stable sealing property can be obtained, it is possible to secure a waterproof property.

Further, since the outer wall portions 45 of the covers 23 protrude outward in the direction of the thickness of the covers 23 from the welded surfaces between the weld line portions 30 of the electric wire receiving table and the weld line portions 39 of the covers 23, it is possible to prevent the welded resin in the weld line portions 30 and 39 from leaking outward from the connector main body 21 at a time of welding in accordance with the ultrasonic oscillation and the pressurization as shown in FIG. 8.

Accordingly, since the outer appearance of the welded waterproof connector is not deteriorated, the good outer appearance can be kept.

What claimed is:

1. A waterproof connector comprising:

a connector main body comprising
- a terminal receiving chamber,
- a side wall having a first weld line portion, and
- a wire receiving table having a first wire receiving groove;

a wire having a cover portion made of a resin;

a cover comprising
- a side wall portion including a second weld line portion, and
- a cover surface portion including a second wire receiving groove aligned with said first wire receiving groove thereby forming a wire receiving hole; and a weld depth setting portion for setting a weld depth at a time of welding, the weld depth setting portion comprising a contact portion and a receiving portion, wherein said contact portion is provided in one of said wire receiving table and said cover, and said receiving portion is provided in the other of said wire receiving table and said cover, wherein said wire is received in said wire receiving hole, said cover covers said wire receiving table, said receiving portion and said contact portion are brought into contact with each other thereby setting the weld depth, said cover portion is welded to said terminal receiving chamber and said first weld line portion is welded to said second weld line portion resulting in a waterproof connection, wherein said receiving portion and said contact portion are not welded together.

2. The waterproof connector according to claim 1, wherein said contact portion is provided in an outer surface side of said side wall portion of said cover, and said receiving portion is provided in an outer surface side of a side wall portion in said wire receiving table.

3. The waterproof connector according to claim 2, said contact portion further comprising an outer wall portion provided in said outer surface side of said side wall portion in said cover surface portion, and said receiving portion comprising a rib provided in a substantially central portion of said outer surface side of said side wall portion in said wire receiving table.

4. The waterproof connector according to claim 1, wherein said weld depth setting portion further comprises a rib having a weld depth setting line portion provided in a substantially central portion of an outer surface side of a side wall portion of said wire receiving table, and an outer wall portion having a setting line portion provided in an outer surface side of a side wall portion in said cover surface portion.

5. The waterproof connector according to claim 4, wherein said weld depth setting portion is a weld resin leakage preventing portion for preventing resin in the weld line portion from leaking outward from the connector main body when welding occurs by ultrasonic oscillation and pressurization.

6. The waterproof connector according to claim 1, wherein said weld depth setting portion is a weld resin leakage preventing portion for preventing resin in the weld line portion from leaking outward from the connector main body when welding occurs by ultrasonic oscillation and pressurization.

* * * * *